US005296081A

United States Patent [19]

Morin et al.

[11] Patent Number: 5,296,081

[45] Date of Patent: Mar. 22, 1994

[54] AUTOMATIC HEAT TRANSFER PRESS FOR TUBULAR STRUCTURES AND CONTAINERS

[75] Inventors: Mark W. Morin, Attleboro; Randolph H. Baker, Foxboro, both of Mass.

[73] Assignee: Geo. Knight & Co., Inc., Brockton, Mass.

[21] Appl. No.: 906,435

[22] Filed: Jun. 30, 1992

[51] Int. Cl.[5] ..... B65C 9/34

[52] U.S. Cl. ..... 156/498; 156/583.3; 156/DIG. 41; 219/243; 219/535

[58] Field of Search ..... 219/243, 535, 521, 544, 219/546, 548, 549; 156/580, 581, 583.3, 583.1, 498, 499, DIG. 41; 100/92

[56] References Cited

U.S. PATENT DOCUMENTS 4,515,651 5/1985 MacLaughlin et al. ..... 156/423
4,769,106 9/1988 Busching ..... 156/497
4,874,454 10/1989 Talalay et al. ..... 156/359
5,019,193 5/1991 Aramini ..... 156/64
5,060,287 10/1991 Van Egmond ..... 219/548 X
5,108,537 4/1992 Garnes et al. ..... 156/447
5,170,704 12/1992 Warren et al. ..... 156/583.1 X

*Primary Examiner*—Michael W. Ball
*Assistant Examiner*—J. Sells
*Attorney, Agent, or Firm*—John P. McGonagle

[57] ABSTRACT

An automatic heat transfer press for imprinting sublimation transfers onto mugs and the like by utilizing heat and contact pressure. The press has three vertically stacked, general sections: a heating chamber, a base, and a cooling chamber interconnecting the heater chamber and base. The heating and cooling chambers are enclosed by a casing. The heating chamber contains the press's two heating units, one for heating the external surface of the mug and the other for heating the interior the mug. The press utilizes a stainless steel sheathed, mineral insulated band heater with a multizone, uniplanar heater element.

3 Claims, 6 Drawing Sheets

AUTOMATIC HEAT TRANSFER PRESS FOR TUBULAR STRUCTURES AND CONTAINERS

BACKGROUND OF THE INVENTION

This invention relates to heat transfer presses, and more particularly to an automatic heat transfer press for tubular structures and containers.

Printed cups, mugs, glasses and other tubular structures (hereinafter collectively "mugs") have become increasingly popular over the past few years, especially as a marketing and advertising tool. There are three basic approaches to printing onto mugs: decal printing, screen printing, and heat transfer.

Decal printing, especially glass decal printing, involves a glass frit arranged onto a decal to form the desired print. The decal is then pressed against the glass or ceramic surface to be imprinted and both the decal and glass placed in an oven. The temperature is gradually increased until the temperature reaches 900 to 1900 degrees F. The process to prepare the decal takes approximately one day for each color and several hours to "fire" the decal onto the mug. Built up color printing is possible, but full color printing is not possible. Whereas in full color printing primary colors can be mixed to attain the desired color, built color printing requires the initial use of the desired end color, the mixing of colors cannot be used.

With screen and pad printing, special glass/ceramic inks can be applied to the surface of the ceramic/glass surface to be imprinted, normally in one color, although two or three colors are possible where close registration is not critical. The printed item is then placed in an oven and the temperature is gradually increased to 900 degrees F. The heating process takes several hours. Generally "firing" takes place after each color on multi-colored designs.

Heat transfer printing is the printing of sublimation transfers onto mugs by heating. The heat transfer process involves transferring sublimation transfers by heat and contact pressure. There are many types of sublimation transfers that can be imprinted. Copy machines can produce a sublimation transfer; video printers can generate a sublimation transfer; laser printers, printing presses, etc. The key to all these images is that they all use a form of "sublimation" ink. The "sublimation" transfer is made up of two basic parts: the transfer release paper and the sublimation dyes. The sublimation dyes are printed onto the transfer release paper. The heat transfer process heats the transfer paper and sublimation dye to a certain temperature. As the temperature of the mug rises during the cycle time, the sublimation dyes start to release from the transfer paper and are transmitted to the coating on the mug. This transitiveness of sublimation dyes from the transfer paper to the coated mug is the key to any heat transfer process. The different types of sublimation transfers work best at different operating temperatures. For example, video processes and films require lower temperatures during the transfer process.

Decal printing is impractical and inflexible for point of sale applications in that the decal printing must be done when the mug itself is fired. Although screen printing has been the historic method of printing onto coffee mugs, the process and equipment required makes it very difficult to print a mug at a point of sale. Heat transfer printing overcomes the limitations of screen and decal printing in that printing may be done at a point of sale, quickly and flexible. Heat transfer printing with sublimations can produce inexpensive "one-of-a-kind" items. The market for cylindrical shaped glass and ceramic products, such as coffee mugs and glasses, lends itself to the one of a kind market. It is also possible to produce full color reproductions of full color designs. The time required to impart a design using heat transfer sublimation can be a matter of seconds and minutes versus hours or days with other technologies.

With heat transfer printing there are several major factors that determine the quality of printing. Among the major variables are: the mug structure, the heat transfer process, mug coating, and transfer placement.

All mugs are different. Each mug has a different wall thickness, ceramic composition, coating, thickness of coating, physical dimensions (inside and outside diameter), slopes, angles, curves, post-curing time of coating, chemical make-up, etc. The differences in mug structures, even two that are nominally alike, must be taken into account by any printing process.

Mug coating plays a major part in the ability to apply a sublimation transfer to a ceramic mug. Ceramic mugs have a hardened layer of material that resists allowing sublimation dyes to impregnate the surface. Mugs to be sublimation printed are coated with a layer of special polymer. These polymers are receptive to sublimation dye, aesthetically acceptable, adhere permanently, and in the case of containers for holding food and beverages, the coating is inert and safe to come in contact with food, skin and may be ingested without causing harm.

Adhering the sublimation transfer to a mug is a critical part of mug printing. Care must be taken to ensure that the transfer paper is tight.

In order to print using sublimation, a properly prepared transfer must be held in tight contact with the receptive surface while heat is applied. The heat and pressure must continue for a sufficient time to allow the sublimation process to complete itself.

The first historic attempts at producing sublimation transfer devices involved the use of cylindrical block heaters. These are heaters which have elements forming two approximate 100 degree arcs about the exterior of the mug. The elements apply heat and pressure to the sublimation transfer to effectuate the imprint transfer. Block heaters have several limitations. The radius of the object to be printed is generally limited to the radius of the heater block. A smaller or larger circumference item does not fit accurately enough into the heat block to produce a uniformly printed surface. Natural irregularities in the surface of the cylindrical container, especially on glass and ceramic objects, create hot spots (places where the pressure is very high) or cold spots (places where the pressure contact is too low). To resolve the latter problem, it is common to place a flexible silicon rubber pad with silicon on the heater block. The rubber pad improves the contact pressure between the heater block and the cylindrical glass or ceramic surface. However, the rubber pad also acts as a heat insulator thereby making it more difficult to attain the needed temperature.

To overcome the limitations of heater blocks heat transfer printing devices for sublimation transfers have been produced using a flexible heater coated with silicon rubber. Such devices allow the mug to be printed up to 300 degrees of the cylinder's circumference. The use of a flexible heater also helps to solve the problem of producing acceptable prints in spite of the natural irregularities in the surface of the glass or ceramic cylindrical surface. The flexible heater also increases the range of cylinder diameters that can be printed.

There are, however, limitations when printing with silicone flexible heaters. The flexible heater has to perform two functions, one of heating and the other of creating uniform contact pressure. The physical properties needed to address the two printing conditions are opposite enough to cause problems. The first problem is that the heater portion of the flexible heater is a fine mesh of conductive resistors which is needed to produce uniform heating over the entire surface. This material is woven and therefore its surface, while flexible on one axis as much as a sheet of typing paper is flexible in one axis, is made of a material hard enough that it imparts its natural weave print onto the printed surface. To eliminate this problem, flexible heaters have been produced that bury the heating unit inside of a silicone rubber material. This eliminates the problem of printing the impression of the woven surface onto the end product's surface, but create new problems. Even though the heater and rubber are flexible by nature, they are produced in a flat state, again much like a sheet of paper, but because of their thickness, which is required to resolve the problem of printing on the naturally irregular surface of glass or ceramic, they do not bend uniformly. The outside of this material sandwich, (which generally measures about ⅜ inch thick), must travel further than the inside surface when being wrapped around an object. The pressure required to wrap and hold the flexible heater against the cylindrical surface to be printed must be applied from the outside, and as a result the inside surface has a tendency to buckle in order to use up the additional material resulting from wrapping this material around a cylinder. This results eventually in wrinkling which is impossible to repair or remove. The wrinkles cause uneven contact pressure to be applied to the cylindrical surface to be printed, thereby resulting in a finished design that reflects the exact shape of the wrinkle. As a result, the flexible heater that develops a wrinkle must be replaced. The wrinkling problem can occur after as few as twenty uses, although it normally lasts for a few hundred uses.

Another problem associated with the flexible heating unit is that the rubber layer and the heating web layer have a tendency to separate after repeated use (as few as fifty, but normally a few hundred uses). This separation creates an electrical shock hazard and further aggravates the problem of surface wrinkles. The heater must be replaced if separation occurs.

A still further problem associated with the prior art flexible heating unit has to do with the natural physical difficulty associated with trying to apply an even pressure between all points of a cylindrical surface and the flexible heating unit. The flexible heating unit wraps around the cylindrical object and applies pressure by pulling from the ends. This tends to create a contact pressure differential at different points about the surface of the cylindrical object. The result is that the print will be darker in areas of high pressure and lighter in the area of low pressure.

Flexible silicon heaters are basically lower temperature devices with external heating devices operating at less than 500 degrees F (Fahrenheit). The temperature limitation is required because silicon breaks down and disintegrates at temperatures approaching 500 degrees F. The lower temperature usually means a longer "dwell" time, i.e., time to transfer the image to the mug. A serious danger with longer dwell times or with high temperatures is that the image being imprinted may burn or yellow.

Prior art heat transfer devices also include devices which heat the inside of a mug with hot air. This is basically a high temperature process. Although effective, these types of devices take from 3 to 4 minutes to accomplish the transfer.

As may be seen in FIG. 9, a conventional ceramic mug 10 has a handle 11, bottom 12, exterior surface 14 and inside opening 13. The mug areas about the handle 11 and bottom 12 are necessarily structurally thicker for support. This results in two "colder" areas on the mug 10 during heat transfer printing. Because of this, prior art heat transfer printing devices have left larger areas around the handle and bottom unprinted or poorly printed. The present invention has a two pronged approach to overcoming the prior art limitations on heat transfer printing.

The press of the present invention allows transfer printing for all transfer types, from processed sublimation and litho transfers to thermal video prints, onto the entire cup—from the very top lip of the cup right to the very bottom and within ½ inch of the handle—in less time than of current transfer machines.

SUMMARY OF THE INVENTION

In view of the foregoing disadvantages inherent in the known types of devices now present in the prior art, the present invention provides an improved heat transfer press for tubular structures and containers. As such, the general purpose of the present invention, which will be described subsequently in greater detail, is to provide a new and improved automatic heat transfer press for tubular structures and containers which will allow transfer printing onto the structure in substantially less time than that of current transfer machines.

To attain this, the present invention provides an enclosed mechanism with a one-piece flexible heater assembly that applies heat to the outside surface of the tubular structure or container, and additionally a second heater for simultaneously applying heat to the inside surface of the tubular structure or container. A means of closing and opening, i.e., actuating the heater around tubular structures or containers, is provided. A means of removing the tubular structure or container from the heated area is provided. A means of increasing imprintable area is provided. The present invention provides a heater with a longer life, i.e., a nominal 3 years life versus a nominal 3 month life for existing heat wrap machines. The mechanism of the present invention substantially reduces dwell time (actual print time).

The heater assembly of the present invention combines the best features of the two piece prior art flexible silicon heaters into a one piece single unit. The heater assembly of the present invention is a band heater imbedding a heater element within a mineral insulation sandwich enclosed within a thin stainless steel sheath. The one piece sheath construction of the present invention provides strength and flexibility without the limitations of the two piece prior art band heaters. The band heater of the present invention provides the high temperatures and watt densities needed, with a maximum efficiency and life. The band heater used in the present invention provides superior heat transfer, faster heat-up and cool-down, and a rugged, contamination-resistant design. It is designed to be in the "At Heat" mode when the machine is being operated, to provide a reservoir of heated mass to quickly heat the cold mug to process temperatures when the mug is inserted to be printed. The band heater provides a reservoir of heat and extremely rapid recovery.

The present invention can be used to imprint indicia on any shaped tubular structure or container. Preferably the tubular structure has a bottom and is opened at the other end (top end). The tubular structure or container can be made of metal, glass, ceramic, plastic or any other material which will not melt at process temperatures. The container can ultimately be used as a drinking or food container or a vessel such as, for example, a mug,, glass, cup, or can be used as a vase, jar, coffee or tea pot, pencil holder, bottle, mail box, mailing tube, test tube, bowl, urn, thermos and flower pot, just to name a few items.

It is, therefore an object of the invention to provide a system to substantially, permanently affix indicia on tubular structures and containers, e.g., drinking containers such as mugs, cups, glasses, cans and the like, using sublimation dyes and other heat applied graphics and/or objects.

It is another object of the invention to provide heating systems to imprint indicia on tubular structures and containers, e.g., mugs, cups, and glasses of different sizes using sublimation dyes and other heat applied graphics and/or objects wherein such heating systems can be used many times without having to be replaced.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
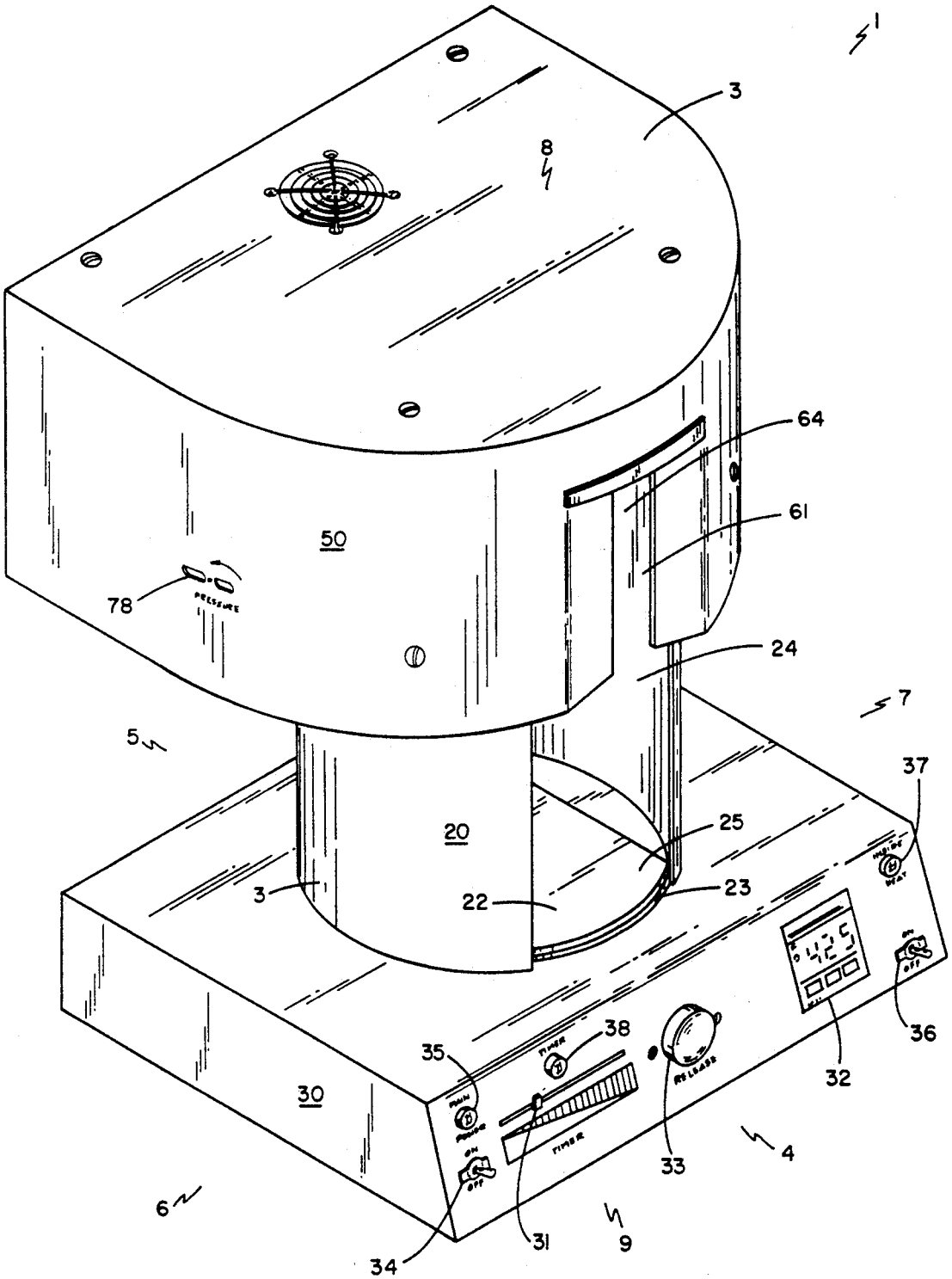
FIG. 1 is a front perspective view of a press constructed according to the present invention.

Referring to the drawings in detail wherein like elements are indicated by like numerals, there is shown in FIG. 1 an embodiment of the invention 1 incorporating an automatic heat transfer press for mugs. The invention 1 has a front 4, back 5, left side 6, right side 7, top 8 and bottom 9. For purposes of exposition all components of the invention will be referred positionally with respect to these directions. The press I may be divided into three, vertically stacked, general sections: heating chamber 50, base 30, and a cooling chamber 20 interconnecting the heater chamber 50 and base 30, of which the heating chamber 50 and cooling chamber 20 are enclosed by an external casing 3. The base 30 provides the ground support for the other two sections and contains the controls, electronics and indicators for the press 1. The heating chamber 50 contains the press's heating units, electromechanicals and pressure adjustments. The cooling chamber 20 is hollow and contains a mug "landing" pad 25, comprised of an energy absorbing foam, at the bottom 23 of the chamber 20.

Figure 2:
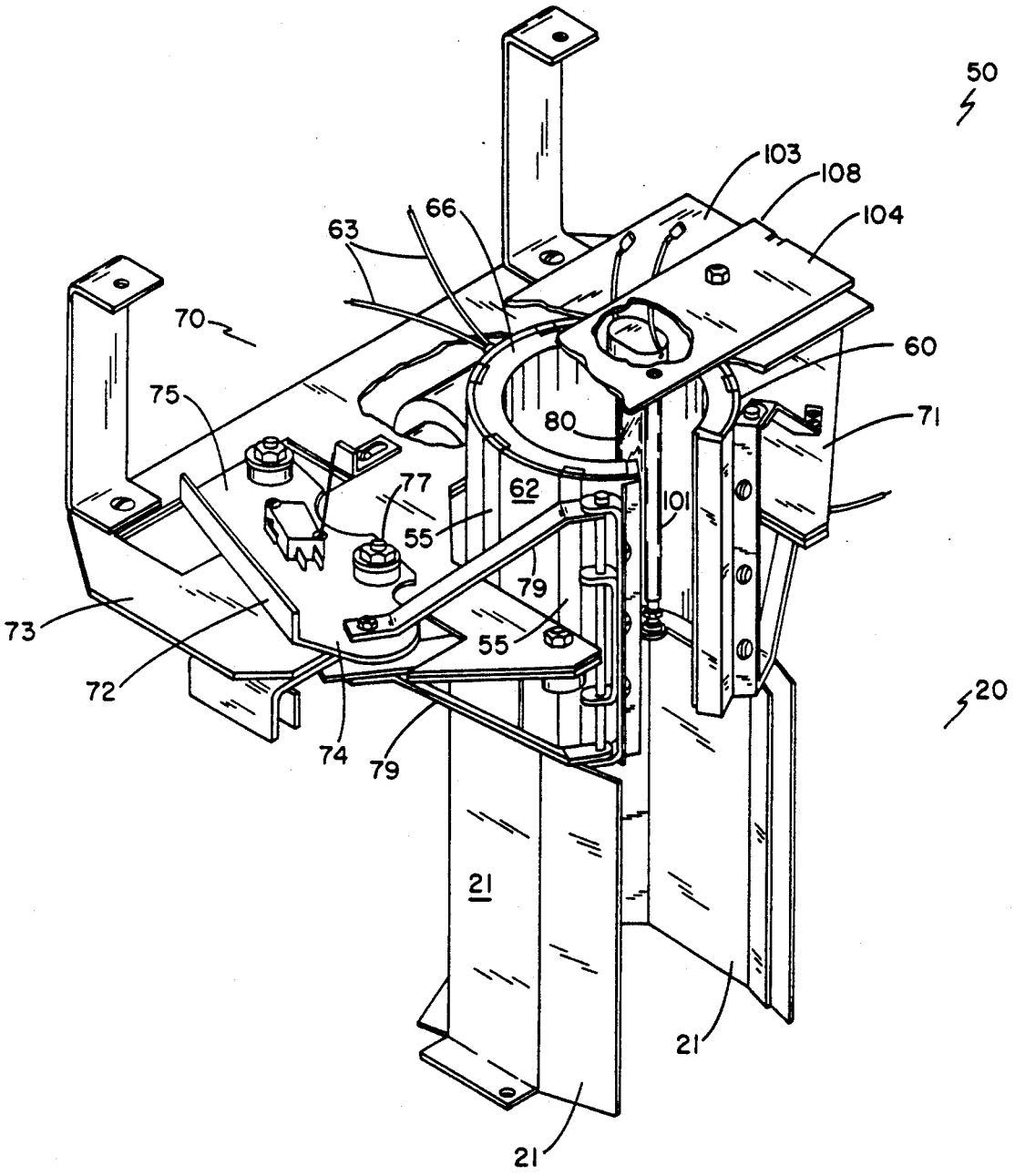
FIG. 2 is a front perspective view of the press of FIG. 1 without a base or external casing.
Figure 3:
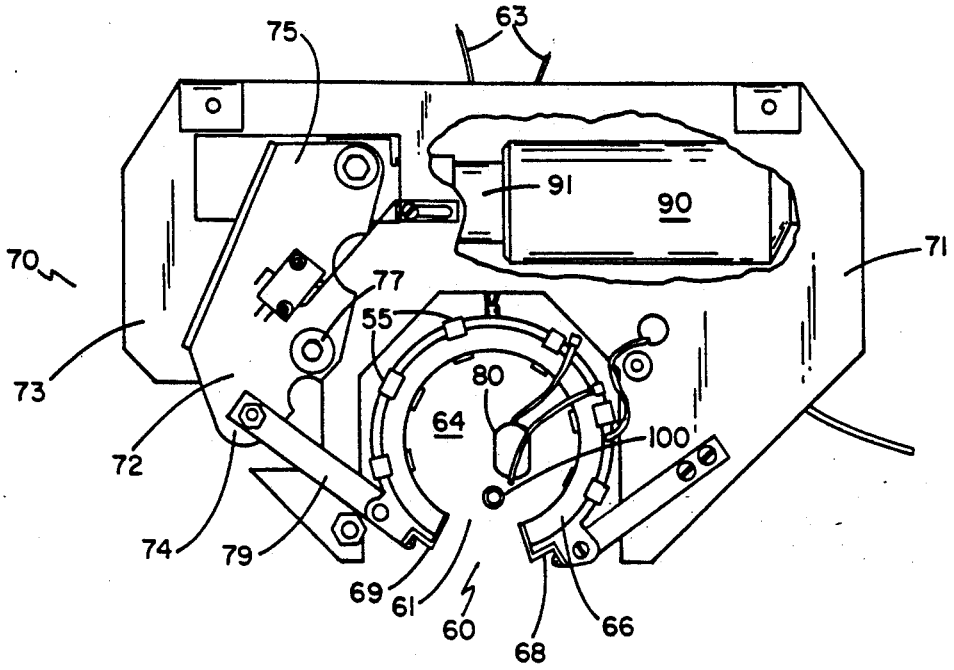
FIG. 3 is a top plan view of the press of FIG. 2.
Figure 4:
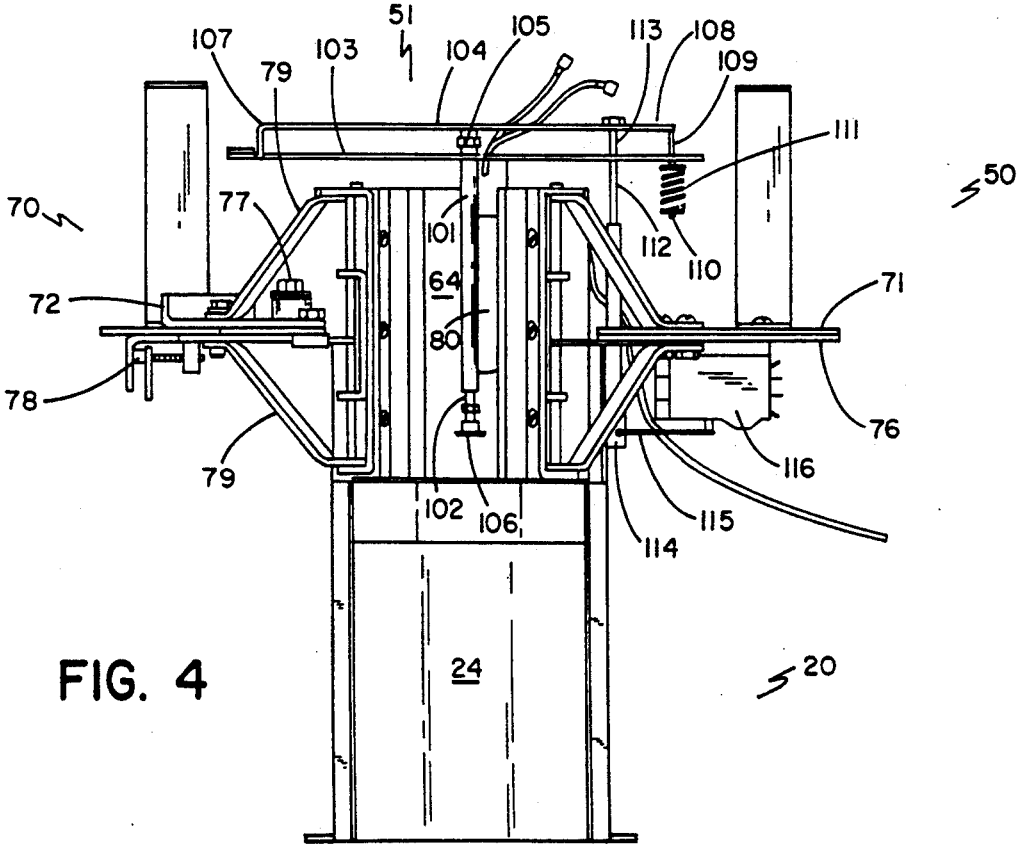
FIG. 4 is a front elevational view of the press of FIG. 2.

FIGS. 2–4 illustrate the heating chamber 50 and cooling chamber 20 with the external casing 3 removed. The cooling chamber 20 is hollow, has a plurality of inner sides 21, a vertical longitudinal axis, and a generally octagonal radial cross sectional shape. The chamber 20 in this embodiment has only five of the normal eight sides of an octagonal shape, the three front most sides having been removed to form a front opening 22 in the cooling chamber 20. Other embodiments could have seven of the normal eight sides of the octagonal shape, the front side having been removed and the adjacent sides spread apart to form a front opening 22 in the cooling chamber 20. The cooling chamber sides 21 provide support for the heating chamber 50 and form a cavity 24 providing a place for a mug 10 to rest and cool after processing.

The heating chamber 50 is comprised of a mineral insulated, steel band heater 60, clamping mechanism 70 and high intensity halogen bulb 80. The band heater 60 is located directly over the cooling chamber 20, has a generally cylindrical shape, and a vertical, central longitudinal axis coincident with the vertical, central longitudinal axis of the cooling chamber 20. The band heater 60 has two positions, normally open and closed, formed by the cylindrical wall 62 of the band heater 60. In the normally open position, the band heater wall 62 has a front, vertical opening 61 formed therein. The clamping mechanism 70 is formed in a general radial plane about the band heater 60 and functions to "close" the band heater 60 about a mug 10 positioned within the band heater wall 62 and to "open" when processing is complete. After the band heater 60 opens, the mug 10 drops down into the cooling cavity 24 where a landing pad 25 cushions the drop. The mug handle 11 protrudes from the band heater vertical front opening 61 even when the band heater 60 is in the "closed" position.

Referring also to FIGS. 5–9, the band heater 60 is comprised of a uniplanar heater element 43, sandwiched between two layers 41, 42 of mineral insulation, which are in turn enclosed within a thin, stainless steel sheath 44. The band heater 60 uses compacted mineral insulation which provides much higher thermal conductivity than the mica and hard ceramics used in conventional heaters. During construction, a thin layer 41 of higher thermal conductivity mineral insulation material separates the heater element 43 from the inside diameter stainless steel sheath 63. A thicker, lower thermal conductivity layer 42 backs up the element 43 to direct heat inward towards the radial center internal cavity 64, i.e., central vertical, longitudinal axis. This construction promotes longer heater life because the heater 60 can operate at high temperatures with lower internal wire temperatures. The uniplanar winding, thin profile and metal fold design contribute to the ability to flex the heater. Applying the heater in a flexing application is novel. Most prior art band heaters are articulated with heating blocks which pivot. In tests, the band heater 60 of the present invention has been flexed over 60,000 times without metal fatigue.

Figure 5:
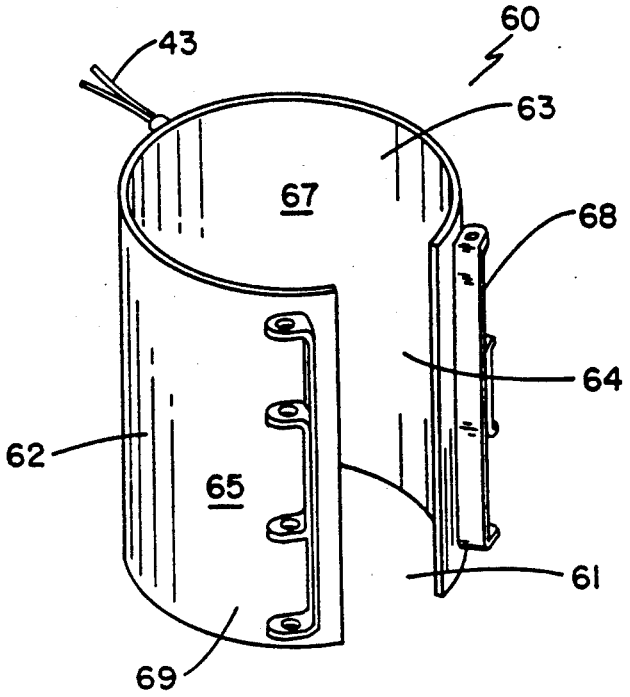
FIG. 5 is a front perspective view of a band heater used in the present invention.
Figure 6:
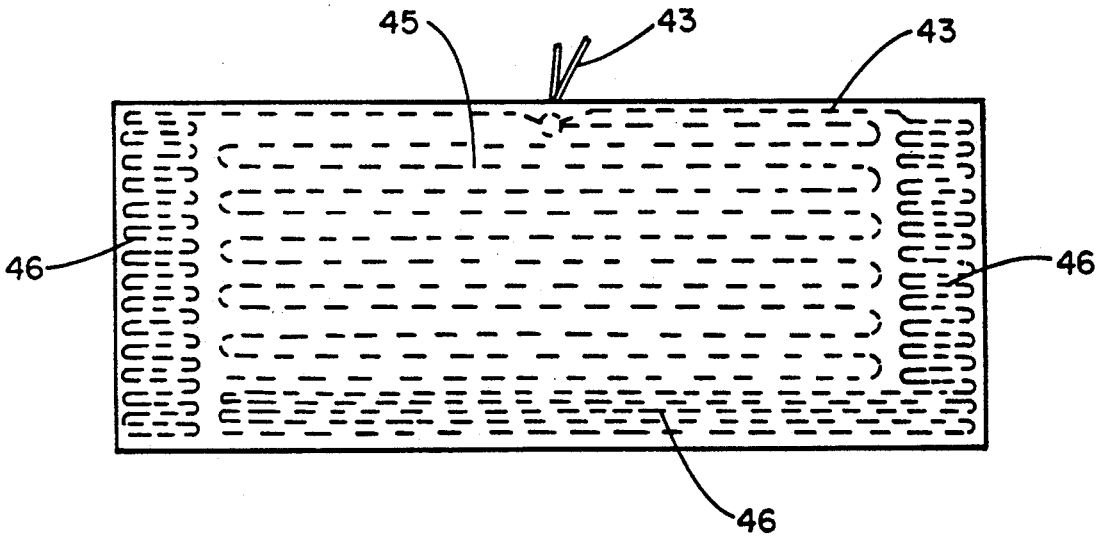
FIG. 6 is a flat, plan schematic view of the heater of FIG. 5.
Figure 7:
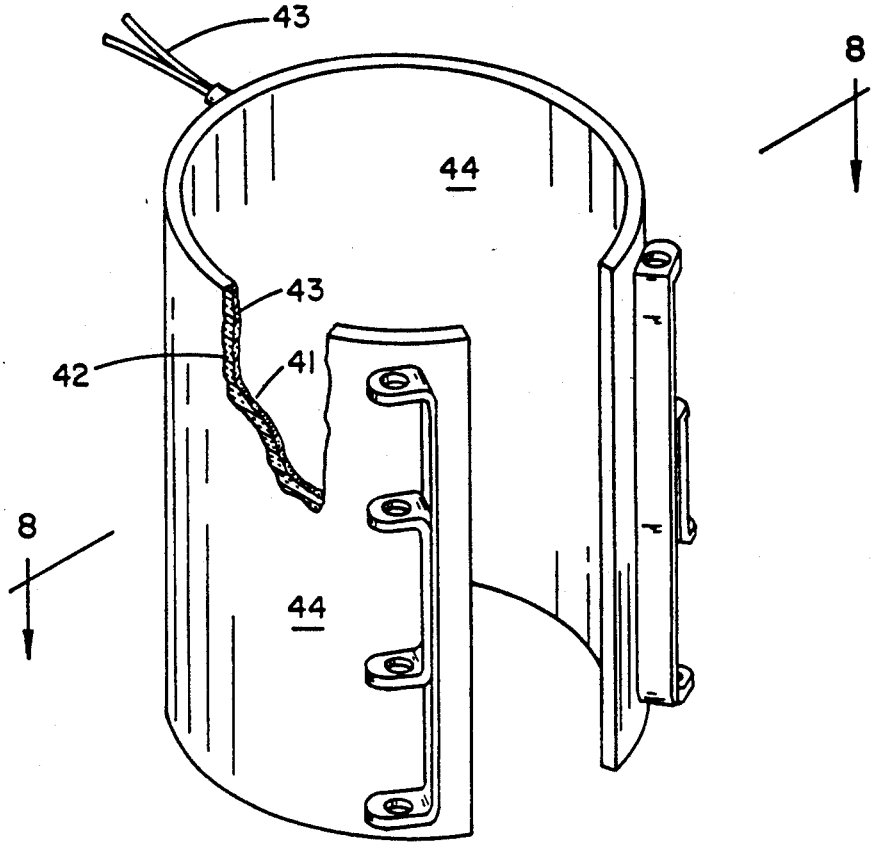
FIG. 7 is a perspective view of the heater of FIG. 5 with a portion removed.
Figure 8:
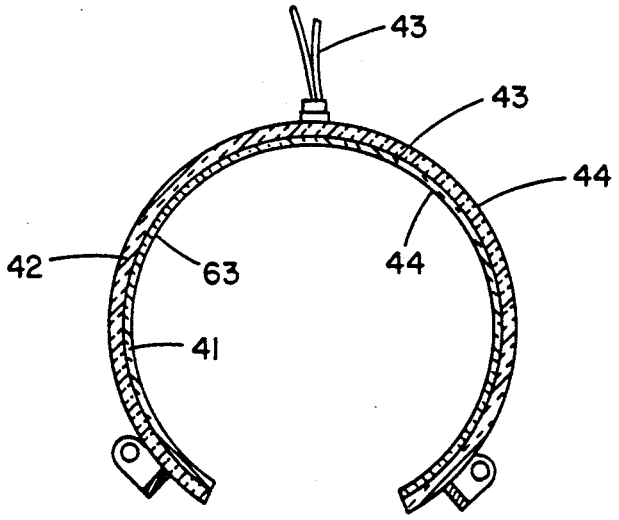
FIG. 8 is a cross sectional view taken along the line 8—8 of FIG. 7.
Figure 9:
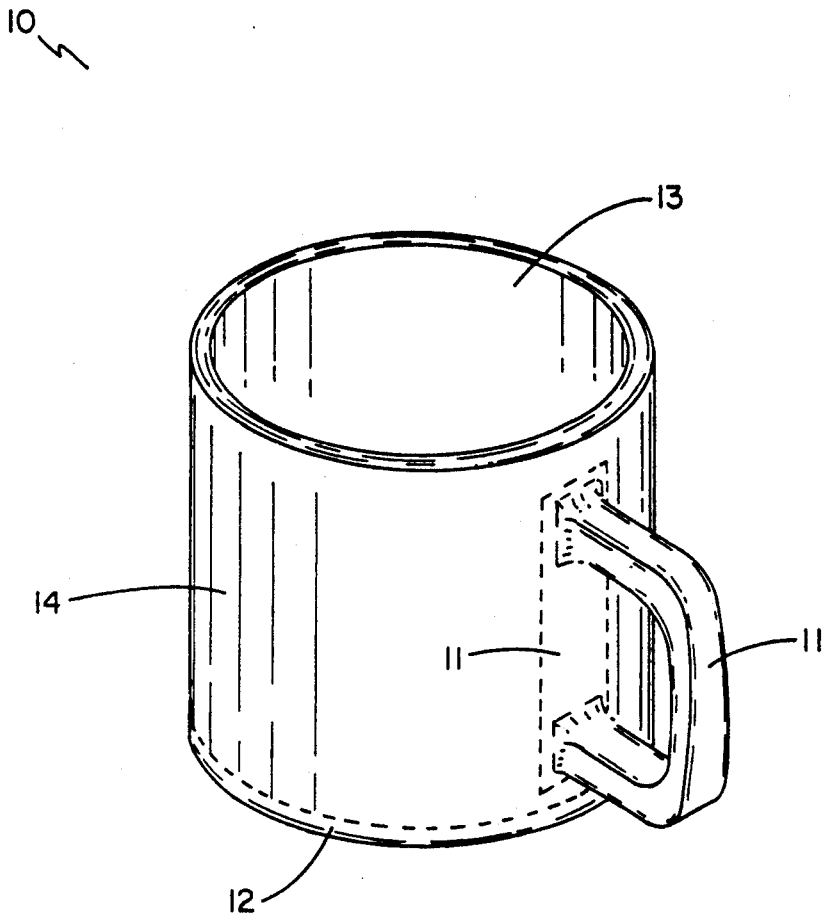
FIG. 9 is a perspective view of a ceramic mug.

As may be seen particularly in FIGS. 5 and 6, the heater element wire and thereby the watt density of the band heater 60 is distributed into a biwattage pattern, two zones 45, 46, that results in a more uniform temperature on the mug's higher mass areas, i.e., handle 11 and bottom 12. The uniplanar heating element 43 is more heavily concentrated in that portion of the band heater 46 which would be adjacent the mug handle area 11 and bottom area 12. The wrap around band heater 60 of the present invention thereby allows extreme top to bottom mug printing.

The band heater 60 has an inner, superconductive, synthetic heater pad 66 located in and along the band heater wall's inner side 67 and held in place by clamps 55. The heater pad 66 is made of a special blend of synthetic rubber, heat tolerant and heat conductive, of low enough durometer to conform to the surface irregularities of the mug or cylindrical object being processed. Prior art pads generally lose approximately 100 degrees F. between heater band and work surface. The pad 66 of the present invention only loses approximately 25 degrees F between heater band inner side 67 and the mug external surface 14. The heat conductive nature of this pad 66 permits the use of higher work surface temperatures than prior art devices.

The clamping mechanism 70 for closing and opening the band heater 60 may be best viewed in FIGS. 2–4. A generally planar, metal brace plate 71 is fixedly positioned in a horizontal plane about the band heater 60. The plate 71 is attached to the band heater wall 62 on the right side 68 near to the front opening 61. A generally planar, closing jaw 72 is pivotally attached in a horizontal plane to the plate's left side 73. Two connecting members 79 interconnect the closing jaw's forward portion 74 with the band heater wall 62 on its left side 69 near to the front opening 61. The closing jaw rearward portion 75 is connected to the drive piston 91 of a linear actuator 90. The actuator 90 is mounted on the plate underside 76 adjacent and parallel to the back side 5 of the press 1. The drive piston 91 extends leftward out of the actuator 90. Activation of the linear actuator 90 causes the actuator's drive piston 91 to extend leftward. This causes the closing jaw rearward portion 75 to also move leftward. The effect of this is to cause the closing jaw 72 to pivot about the pivotal jaw-plate connection (pivot) 77. This in turn causes the closing jaw forward portion 74 to move rightward. This in turn exerts rightward pressure on the two connecting members 79 interconnect the closing jaw's forward portion 74 with the band heater wall 62 on the heater left side 69 near to the heater front opening 61. The heater wall 62 is thereby closed about a mug (not shown) within the heater internal cavity 64. After full closure around the mug 10, an internal timer shuts off power to the actuator 90. Activation of the actuator 90 also activates the heater 80. After the desired period of time has passed, the heater 80 is shut off and the action of the closing jaw 72 is reversed. This will cause the mug (not shown) held within the band heater internal cavity 64 to fall by gravity into the cooling chamber 20, the mug's fall being cushioned by the landing pad 25.

The press 1 applies pressure to the mug by closing the band heater 60 around it. The press 1 is preset for "standard" mugs. The band heater 60 will continue to close until the mug has been fully wrapped. Pressure may be adjusted if the mugs used are larger than the inside diameter (internal cavity 64) of the band heater 60. The inside opening 64 can be adjusted by adjustment means 78 provided to move the pivot point 77 leftward or rightward. In this particular embodiment of the invention adjustment means (not shown) are inserted into the slot marked pressure 78 and turned to "open" up the band heater wall 62. The adjustment is made until the mug can be inserted "freely". If the mug will not stay up in the press or if additional pressure is desired, the adjustment means is used to "close" up the band heater 60. Adjustment is made so the mug is just able to be inserted without "binding up". This adjustment allows for a variety of different diameter mugs to be used in this machine 1.

The press 1 has a solid state timer (not shown) which is activated when the mug has been "inserted" fully into the band heater internal cavity 64 and the inside of the mug bottom 12 contacts and actuates the switching mechanism 100. The mug 10 normally is held in position until the band heater 60 has fully wrapped. The timer will automatically open the heater band wall 62 once the cycle is completed. To adjust the cycle time a "Time Knob" 31 on the base 30 is slid to the appropriate setting.

The switching mechanism 100 has a hollow, vertical switch cylinder 101 extending downward into the band heater central cavity 64 near to the cavity's front opening 61. The switch cylinder 101 has an elongated activator switch 102 concentrically and slidably located within and having one end 106 extending below the switch cylinder 101. The switch cylinder 101 is fixedly attached to a horizontal holding plate 103 mounted on the top 51 of the heating chamber 50. Said holding plate 103 has an opening (not shown) formed therein corresponding to the interior opening of the switch cylinder 101. Pivotally attached above and to said holding plate 103 is a horizontal switch plate 104. One end 105 of the activator switch 102 extends upwardly from the switch cylinder 101 through said holding plate opening to said switch plate 104 where it is fixedly attached. The switch plate 104 is pivotally attached to said holding plate 103 along its left side 107. The switch plate right side 108 has a downwardly extending element 109. The element 109 protrudes through a second opening (not shown) in the holding plate 103 and terminates in a radial flange fastener 110. A spring element 111 is positioned about the element 109 between the flange fastener 110 and holding plate 103 thereby exerting a downward pressure on the switch plate right side 108. A vertical switch trigger 112 is fastened at one end 113 to the switch plate 104 and positioned so that is extends downwardly through a third opening (not shown) in the holding plate 103. The vertical switch trigger 112 opposite end 114 terminates in a horizontal arm 115 mechanically connected to a double pole switch 116. The double pole switch 116 provides power when activated to the machine I and to the inside heater 80. To activate the switch 116 a mug 10 is inserted into the band heater cavity 64 wherein the mug's inside bottom 12 forces the activator switch end 106 upward. This action pushed and holds the activator switch 102 up within the switch cylinder 101 thereby causing the switch plate right side 108 to move upwardly. The pivoting action of the switch plate 104 pulls the vertical switch trigger 112 upward thereby causing the trigger arm 115 to activate the switch 116. The compression pressure on the spring element 111 ensures that the switch plate right side 108 will come down after upward pressure on the activator switch 102 is released.

When the mug has been inserted into the band heater internal cavity 64, the timer will activate. A timer activate light 38 located directly above the time knob 31 lights up to let the operator know that the timer has been activated. This light 38 will shut off when the timer has released.

The press 1 is also provided with a digital temperature control 32 on the base 30 which is used to regulate the temperature of the band heater 60. The band heater 60 can be easily set for process temperature.

The press 1 is also provided with a release button 33. The release button 33 is located in the center of the bottom base 30 and is designed to allow the operator to release the mug anytime during the cycle time. To release the mug, the release button 33 is pushed "IN" and held in that position until the band heater 60 has fully opened and the "Timer Activated" light is out. The release button 33 will only release after 3–4 seconds have passed. This will reset the Timer automatically.

Main power can be shut on and off by a switch 34 located on the left hand side of the base 30 front. The switch 34 is in the "ON" position when the "Red" pilot light 35 is on.

As stated above a conventional ceramic mug 10 has a handle 11 and bottom 12. The mug areas about the handle 11 and bottom 12 are necessarily structurally thicker for support. This results in two "colder" areas on the mug 10 during heat transfer printing. The present invention 1 overcomes a portion of this problem by providing supplemental heater, i.e., a halogen bulb 80 in this embodiment, to provide additional heat to the mug's handle area 11 from the mug's interior opening 13. Other forms of generated heat may be used such as a quartz bulb, or an open wound radiant heater cartridge, and the like. As may be seen in FIGS. 3 and 4, the bulb heater 80 extends vertically downward from the top 51 of the heating chamber 50 and extends into the internal central, vertical cavity 64 formed by the band heater walls 62. As may be seen especially from FIG. 3, the bulb 80 is vertically positioned toward the band heater front opening 61 directly behind and slightly to the right of the switch cylinder 101. When a mug 10 is brought up into the band heater central cavity 64 from the lower cooling chamber 20, the resultant position of the bulb heater 80 is inside the mug central opening 13 near to the mug handle area 11. The unique thermal bulb heating system 80 provides a powerful source of heat from inside 13 the mug 10. As a result, ceramic mugs can be printed in less than one minute, half the time of prior art systems.

The halogen heater bulb 80 has a separate switch 36 and pilot light 37. This allows the inside heater bulb 80 to be activated. This switch 36 only controls the heater bulb 80 function. A separate pilot light 37 indicates that the heater bulb 80 function is activated.

OPERATION

The press 1 is turned "ON" with the toggle power switch 34. Dwell time and heater temperature can be adjusted by manipulation of the time knob 31 and digital temperature control 32 to accommodate transfer manufacturer's specifications. When starting up the machine 1 several minutes are required to allow the band heater 60 and inner pad 66 to stabilize their temperatures. If inside heat is required (ceramic mugs), the halogen bulb switch 36 is activated.

Intended graphics are positioned on the mug and attached thereto using high temperature adhesive or the like. It is important to eliminate any wrinkles.

The mug is positioned within the cooling chamber 20 and lifted up by its handle up into the band heater internal cavity 64 until the mug bottom 12 activates the switch mechanism 100 and held in that position until the band heater wall 62 has fully wrapped around the mug (not shown). The mug handle 11 can then be released by the operator.

At this time heat is being applied to the outside of the mug and (when applicable) to the inside as well.

At the end of the preset time, the mug is automatically released and drops into the cooling chamber 20.

The automatic operation makes the press 1 of the present invention even more operator efficient. Once the mug has been inserted into the heating chamber 50, the band heater 60 closes automatically to hold the mug during the heating process. At the end of the cycle, the press 1 delivers the mug to the cooling area (chamber) 20. This hands-free operation allows the operator to prepare the next transfer or perform other tasks. The mug handle remains cool to the touch throughout the procedure so that the mug can be removed immediately to be peeled or plunged into water for rapid cooling.

The adjustable solid state digital temperature control 32 is easy to read with a large bright and accurate read out.

The linear timer knob 31 allows the operator to set the time required for processing. The easy-to-read graphics provide accurate and consistent settings.

Applied pressure adjustments are fast and simple to accommodate the different circumferences of mugs.

The transfer cycle can be interrupted at any time by pushing the red release button 33 located in the middle of base front.

It is understood that the above-described embodiment is merely illustrative of the application. In another embodiment of the invention, the band heater pad 66 may have a heat conductive, medium density sponge rubber sheet 57 laminated to the internal cavity 64 side of the pad 66. This provides physical protection to the pad 66 during use. Other embodiments may be readily devised by those skilled in the art which will embody the principles of the invention and fall within the spirit and scope thereof.

We claim:

1. An automatic heat transfer press for imprinting sublimation transfers onto a tubular structure or container opened on at least one end thereof by utilizing heat and contact pressure, comprising:

a base;

a cooling chamber vertically mounted on said base, wherein said cooling chamber has a plurality of vertical sides, a vertical longitudinal axis, a bottom and a front opening, said sides providing support for a heating chamber and defining a cavity with a pad comprised of an energy absorbing foam, at the bottom of said cavity;

a heating chamber vertically mounted on said cooling chamber, wherein said heating chamber is comprised of:

a flexible, generally cylindrical, mineral insulated, metal band heater having a horizontal radial axis and a central, vertical longitudinal axis defining an interior cavity in which said tubular structure or container is concentrically and centrally positioned, wherein said band heater is comprised of a uniplanar heater element, sandwiched between first and second layers of compacted mineral insulation, which are in turn enclosed within a thin, metallic sheath, wherein the first of said insulation layers is a relatively thin, higher thermal conductivity layer separating the heater element from the inside diameter portion of the metallic sheath, and the second of said insulation layers is a relatively thick, lower thermal conductivity layer separating the heater element from the outside diameter portion of the metallic sheath, said second layer backing up said heater element to direct heat inward towards the interior cavity of said band heater, wherein the heater element is more heavily concentrated in that portion of the band heater which would be adjacent the tubular structure or container higher mass areas, said band heater having two positions, normally open and closed, formed by the cylindrical sheath of the band heater, wherein in the normally open position, t he band heater has a front, vertical opening formed therein;

a clamping mechanism for opening and closing said band heater about said tubular structure or container, wherein said clamping mechanism is formed in a general radial plane about the band heater and is adapted to close the band heater about a tubular structure or container positioned within the band heater interior cavity and to open the band heater when processing is complete; and a heater extending vertically downward into said band heater cavity and positioned within said open end of said tubular structure or container; and an external casing enclosing said cooling and heating chambers.

2. A press as recited in claim 1, wherein:

said band heater interior cavity is located directly over said cooling chamber cavity.

3. A press as recited in claim 2, wherein said clamping mechanism is comprised of:

a generally planar, metal brace plate having left and right sides, and an underside, fixedly positioned in a horizontal plane about the band heater, whose right side is fixedly attached to said band heater on one side of said band heater front, vertical opening;

a generally planar, closing jaw having a forward portion and a rearward portion, said jaw pivotally attached in a horizontal plane to the plate's left side, and having two connecting members interconnect the closing jaw's forward portion with the band heater wall on the side near to the heater front vertical opening opposite the side to which the plate is fixedly attached; and a linear actuator with a drive piston connected to the closing jaw rearward portion, said actuator being mounted on the plate underside, said drive piston being adapted to cause the closing jaw to pivot about the pivotal jaw-plate connection, thereby interacting with the band heater wall to close or open said band heater about said tubular structure or container.

* * * * *